US005536627A

United States Patent [19]

Wang et al.

[11] Patent Number: 5,536,627

[45] Date of Patent: Jul. 16, 1996

[54] PHOTOGRAPHIC ELEMENTS WITH IMPROVED CINCH SCRATCH RESISTANCE

[75] Inventors: Yongcai Wang, Penfield; Alfred B. Fant; Dennis E. Smith, both of Rochester, all of N.Y.

[73] Assignee: Eastman Kodak Company, Rochester, N.Y.

[21] Appl. No.: 407,936

[22] Filed: Mar. 21, 1995

[51] Int. Cl.[6] ..... G03C 1/32

[52] U.S. Cl. ..... 490/523; 430/531; 430/535; 430/631; 430/950; 430/960

[58] Field of Search ..... 430/523, 631, 430/961, 531, 641, 535, 950

[56] References Cited

U.S. PATENT DOCUMENTS

| | | | |
|---|---|---|---|
| 3,976,490 | 8/1976 | Macleish | 96/84 |
| 4,275,146 | 6/1981 | Yoneyama et al. | 430/523 |
| 4,287,299 | 9/1981 | Himmelmann et al. | 430/537 |
| 4,582,784 | 4/1986 | Fukugawa et al. | 430/523 |
| 4,623,614 | 11/1986 | Yoneyama et al. | 430/523 |
| 4,855,219 | 8/1989 | Bagchi et al. | 430/523 |
| 4,866,469 | 9/1989 | Shiba et al. | 354/202 |
| 4,873,181 | 10/1989 | Miyasaka et al. | 430/523 |
| 4,975,363 | 12/1990 | Cavallo et al. | 430/637 |
| 5,057,407 | 10/1991 | Okamura et al. | 430/531 |
| 5,061,595 | 10/1991 | Gingello et al. | 430/264 |
| 5,104,777 | 4/1992 | Schmidt et al. | 430/510 |
| 5,175,073 | 12/1992 | Gingello et al. | 430/264 |
| 5,227,285 | 7/1993 | Hattori et al. | 430/534 |
| 5,310,640 | 5/1994 | Markin et al. | 430/527 |

FOREIGN PATENT DOCUMENTS

| | | |
|---|---|---|
| 0567118A2 | 10/1993 | European Pat. Off. . |
| 47-18004 | 5/1972 | Japan . |

OTHER PUBLICATIONS

JP 05/297506–A (Abstract in English).

*Primary Examiner*—Thorl Chea
*Attorney, Agent, or Firm*—Robert A. Gerlach

[57] ABSTRACT

A photographic element comprising a support having a front side and a back side, an image forming layer on the front side of the support, a protective overcoat on the front side of the Support further removed from the support than the image forming layer, the protective overcoat comprising process surviving matte particles in a hydrophilic binder, the matte particles having a Rockwell hardness of less than M90, the back side of the support having a protective overcoat layer, the protective overcoat layer being the layer furthest removed from the back side of the support and comprising a hydrophobic material having a Delta haze less than 30%.

19 Claims, No Drawings

PHOTOGRAPHIC ELEMENTS WITH IMPROVED CINCH SCRATCH RESISTANCE

FIELD OF THE INVENTION

This invention relates to imaging elements and in particularly to photographic elements comprising a support, an image-forming layer, and protective topmost layers. More specifically, this invention relates to protective topmost layers containing matte particles in a film forming binder and to protective layers in photographic elements to reduce matte cinch scratches and abrasion marks during the manufacturing and use of such photographic elements.

BACKGROUND OF THE INVENTION

Photographic elements generally comprise hydrophilic binders, e.g. gelatin as vehicles for the imaging chemistry and in the protective overcoat. These hydrophilic colloids can absorb moisture and become tacky in humid environments and at elevated temperatures causing the photographic materials to stick to each other, for example, if packed in a stack. To eliminate these difficulties, it is conventional to incorporate finely powdered grains or matting agents (beads) into the protective layer to increase the surface roughness and prevent contact and subsequent sticking. It is desirable that these matte beads are non-hydrophilic and consequently they are comprised of materials different from the binders. Because of the different composition, these matte beads may have different refractive index. When light is passed through the photographic element, such as in photographic printing or projection, both the increased surface roughness and difference in refractive index can cause a non-uniform light path and result in graininess in photographic prints or mottle in projected images. For this reason, manufactures have been using a large amount of non-process surviving (soluble) mattes, designed to solubilize in high pH solutions, in combination with a small amount of process surviving (permanent) matte.

In recent years, the conditions under which the photographic materials are utilized have become more severe. For example, conventional photographic materials are designed for storage and housing after processing in a plastic pouch or envelope where the processed photographic materials do not come into direct contact. In recent years, there is an increase in demand for photographic materials to be returned post process in the cartridge for storage and future interface needs. The photographic materials come into direct contact during these post process windings, unwinding, rewinding, and handling. This requires the use of an increased level of processing surviving mattes for reducing self-adhesion. However, it has also caused an increase in matte cinch scratches and abrasion marks on the photographic materials which may become visible on projection or subsequent printing.

Recently, significant advancements have been made with regard to the methods of preparing photographic material. For example, the speed of coating, finishing, cutting, and processing has been increased. These improvements have also resulted in a significant increase in the amount of scratches and abrasion marks on the side opposite to that containing matte particles.

Therefore the present invention is directed to the objective of providing improved topmost protective layers which allow photographic elements to be used in humid environments and at elevated temperatures with good ferrotyping performance both before and after processing, and which also provide photographic elements with excellent resistance to matte cinch scratch and abrasion in manufacture and use.

SUMMARY OF THE INVENTION

In accordance with the present invention, a photographic element comprises a support, at least one image- forming layer, a non-image-forming hydrophilic topmost layer on the side of the image-forming layer (hereinafter referred to as the front side), and a hydrophobic topmost layer on the opposite side to that of the image-forming layer (hereinafter referred to as the back side). The non-image-forming topmost layer on the front side contains a process surviving matting agent composed of materials having a Rockwell hardness value of less than M90 . The hydrophobic topmost layer on the back side has a delta haze value of less than 30%.

The photographic elements in accordance with this invention demonstrate improved resistance to matte cinch scratches and abrasion marks at high levels of matte coating coverages, which are required to protect the elements from ferrotyping and blocking at high temperatures and humidities.

DETAILED DESCRIPTION OF THE INVENTION

Photographic elements according to this invention can differ widely in structure and composition. For example, they can vary greatly in regard to the type of the support, the number and composition of the imaging forming layers, and the kinds of auxiliary layers that are included in the elements on both the front and back sides of the support. In particular, the photographic elements can be still films, motion picture films, x-ray films, graphic arts films, paper prints or microfiche. They can be black-and-white elements, color elements adapted for use in a negative-positive process, or color elements adapted for use in a reversal process. Supports are made from polymeric materials including cellulose nitrate, cellulose acetate, poly(vinyl acetyl), polystyrene, poly(ethylene terephthalate), poly(ethylene naphthalate), polycarbonate, glass, metal, paper, polymer-coated paper, and the like.

It is apparent to those skilled in the art that the photographic element described herein may be exposed in either a conventional reloadable camera or a prepackaged photographic unit, also known as a Single Use Camera.

Hydrophilic Matte Containing Layer

As described herein above, the photographic elements of this invention include a topmost protective layer comprising a processing surviving matting agent in a film-forming binder. The matting agents useful for the present invention are composed of polymeric materials which have a Rockwell hardness value of less than M90, preferably less than M85 and most preferably from M85 to M40. Typical Rockwell M values for some common plastic materials can be found in "Plastics Technology Handbook" by M. Chanda and S. K. Roy, 2nd Ed, Rev. and Expanded, Marcel Dekker, Inc., 1993. For example, polystyrene has a Rockwell hardness M value of 83, and poly(methyl methacrylate) has a Rockwell hardness M value of 102. The Rockwell hardness value can be measured according to ASTMID.785-51.

Polymeric matte particles include cellulose esters, cellulose ethers, starches, addition-type polymers and interpolymers prepared from ethylenically unsaturated monomers such as acrylates including acrylic acid, methacrylates including methyl methacrylate and methacrylic acid, acrylamides and methacrylate amides, itaconic acid and its half esters and diesters, styrenes including substituted styrenes, acrylonitriles and methacrylonitriles, vinyl acetates, vinyl ethers, vinyl and vinylidene halides and olefins. In addition, crosslinking and grafting monomers such as 1,4-butylene glycol methacrylate, trimethylolpropane triacetate, allyl methacrylate, diallyl phthalate, divinyl benzene, and the like may be included. Other polymers include condensation polymers such as polyurethanes, polyesters, polyamides, epoxies, and the like. The composition of polymers or copolymers must be chosen to have a Rockwell hardness value of less than M90. There is no particular restriction on the shape of the matte particles. However, they preferably have a regular spherical shape. The mean size of the matte particles is in the range of from 0.2 to 10 micrometers and preferably from 0.5 to 5 micrometers. The matte particles have a glass transition temperature of at least 50° C. to resist any large degree of mechanical deformation.

The matte particles can be prepared by pulverizing and classification of organic compounds, by emulsion, suspension, and dispersion polymerization of organic monomers, by spray drying of a solution containing organic compounds, and by polymer suspension technique which consists of dissolving an organic material in a water immiscible solvent, dispersing the solution as fine liquid droplets in aqueous solution, and removing the solvent by evaporation or other suitable techniques. The bulk, emulsion, dispersion, and suspension polymerization procedures are well known to those skilled in the polymer art and are taught in such textbook as G. Odian in "Principles of Polymerization", 2nd Ed. Wiley (1981), and W. P. Sorenson and T. W. Campbell in "Preparation Method of Polymer Chemistry", 2nd Ed, Wiley (1968).

The matte particle surface may include reactive functional groups which form covalent bonds with binders by intermolecular crosslinking or by reaction with a crosslinking agent (i.e. a hardener). Suitable reactive functional groups include: hydroxyl, carboxyl, carbodiimide, epoxide, aziridine, vinyl sulfone, sulfinic acid, active methylene, amino, amide, allyl, and the like. There is no particular restriction on the amount of reactive groups present, but their concentrations are preferably in the range of from 0.5 to 10 weight percent. The particle surface may be surrounded with a layer of colloidal inorganic particles as described in U.S. Pat. Nos. 5,288,598, and 5,378,577 or a layer of colloidal polymer latex particles which have affinity with suitable binder as described in U.S. Pat. No. 5,279,934, or a layer of gelatin as described in U.S. Pat. Nos. 4,855,219, all of which are incorporated herein by reference.

Any suitable hydrophilic binder may be used in practice of the present invention. The binder is preferably coated at a coverage greater than 0.1 $g/m^2$ to provide effective adhesion of the matte particles to the surface of the element. Most preferably, the coverage is from 0.3 to 2 $g/m^2$. The matte is coated at a coverage of from 0.01 to 0.25 $g/m^2$, and preferably from 0.03 to 0.15 $g/m^2$.

Suitable hydrophilic binders include both naturally occurring substances such as proteins, protein derivatives, cellulose derivatives including cellulose esters, such as, cellulose diacetate cellulose triacetate, cellulose acetate butyrate; gelatins and gelatin derivatives, polysaccharides, casein, and the like, and synthetic water permeable colloids such as poly(vinyl lactams), acrylamide polymers, poly(vinyl alcohol) and its derivatives, polysilicic acid, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl acrylate and methacrylates, vinyl imidazole copolymers, vinyl sulfide copolymers, homopolymer or copolymers containing styrene sulfonic acid, and the like. Gelatin is a preferred hydrophilic binder.

The binder and its level should be chosen so that it effectively adheres the matte particles to the surface of the element. For crosslinkable binder such as gelatin, the binder is preferably cross-linked so as to provide a high degree of cohesion and adhesion. Crosslinking agents or hardeners which may effectively be used in the coating compositions of the present invention include aldehydes, epoxy compounds, polyfunctional aziridines, vinyl sulfones, melamines, triazines, polyisocyanates, dioxane derivatives such as dihydroxydioxane, carbodiimides, chrome alum, zirconium sulfate, and the like.

The protective layer useful in the practice of the invention may optionally contain surface active agents, antistat agents, charge control agents, thickeners, ultraviolet ray absorbers, processing removable dyes, processing removable matte particles, high boiling point solvents, silver halide particles, colloidal inorganic particles, magnetic recording particles, polymer latex particles, and various other additives.

The hydrophilic matte containing layer useful in the practice of the invention can be applied by any of a number of well-known techniques, such as dip coating, rod coating, blade coatings, air knife coating, gravure coating, reverse roll coating, extrusion coating, slide coating, curtain coating, and the like. The matte particles, other addenda, and the binder are preferably mixed together in a liquid medium to form a coating composition. The liquid medium may be a medium such as water or other aqueous solution in which film formers are dispersed with or without the presence of surfactants. After coating, the protective layer is generally dried by simple evaporation, which may be accelerated by known techniques such as convection heating. Known coating and drying methods are described in further detail in *Research Disclosure* No. 308, December 1989, pp. 1007–1008.

Hydrophobic Layer

The hydrophobic topmost back side layer useful for the present invention should have good scratch and abrasion resistance. If its scratch resistance is too low, even matting agents of low Rockwell hardness can easily scratch it. The abrasion resistance of the hydrophobic topmost layer can be measured according to ASTM D1044 method. When the testing is carried out at 70° F. and 50% RH and at a total weight of 125 grams between the abrasive wheels (double #CS-10F abrasive wheel) and the sample for 100 cycles at 72 RPM, the hydrophobic topmost layer should have a delta haze value (measured with an XL-211 Hazeguard System Haze meter) of less than 30%, preferably less than 20% and most preferably from 15 to 5%.

Suitable hydrophobic materials include polyesters including polyesterionomers, polyurethanes including polyureas and polyurethane-ureas, polyamides, polyimides, polysulfones, epoxide polymers, celluloses and their derivatives, polyacetals; polymers or copolymers prepared from ethylenically unsaturated monomers such as acrylates including acrylic acid, methacrylic acid, methacrylates including methacrylic acid, acrylamides and methacrylate amides, itaconic acid and its half esters and diesters, styrenes including substituted styrenes, acrylonitriles and methacrylonitriles, vinyl acetates, vinyl ethers, vinyl and vinylidene halides and olefins or their mixtures. In addition, crosslinking and grafting monomers such as 1,4-butyleneglycol methacrylate, trimethylolpropane triacetate, allyl methacrylate, diallyl phthalate, divinyl benzene, and the like maybe used. Such hydrophobic layers have been described in, for example, U.S. Pat. Nos. 4,582,784; 4,612,279; 4,735,976; 4,497,917; and 5,366,855.

The above hydrophobic materials may contain reactive functional groups capable of forming covalent bonds by intermolecular cross-linking or by reaction with a cross-linking agent. Suitable reactive functional groups include hydroxyl, carboxyl, carbodiimide, epoxide, aziridine, vinyl sulfone, sulfinic acid, active methylene, amino, amide, allyl, and the like. The topmost hydrophobic layer may also contain suitable crosslinking agents, which include aldehydes, epoxy compounds, polyfunctional aziridines, vinyl sulfones, melamines, triazines, polyisocyanates, dioxane derivatives such as dihydroxydioxane, carbodiimides, chrome alum, zirconium sulfate, and the like.

The topmost hydrophobic protective layer may contain a certain amount of water,soluble or/swellable materials. The concentration of these materials should not be too high to cause the protective layer to be totally removed, for example, during photographic processing. Such suitable hydrophilic materials include substances such as proteins, protein derivatives, cellulose derivatives (e.g. cellulose esters), gelatins and gelatin derivatives, polysacharides, casein, and the like, and synthetic water permeable colloids such as poly(vinyl lactams), acrylamide polymers, poly(vinyl alcohol) and its derivatives, hydrolyzed polyvinyl acetates, polymers of alkyl and sulfoalkyl acrylates and methacrylates, polyamides, polyvinyl pyridine, acrylic acid polymers, maleic anhydride copolymers, polyalkylene oxide, methacrylamide copolymers, polyvinyl oxazolidinones, maleic acid copolymers, vinyl amine copolymers, methacrylic acid copolymers, acryloyloxyalkyl acrylate and methacrylates, vinyl imidazole copolymers, vinyl sulfide copolymers, homopolymer or copolymers containing styrene sulfonic acid, and the like.

The topmost hydrophobic protective layer may optionally contain addenda, such as, but not limited to surface active agents, charge control agents, antistat agents, such as, conductive polymers or conductive metal oxide particles as described, in U.S. Pat. No. 4,394,441, thickeners, magnetic recording particles, slip agents, matte agents, metal oxide particles, and various other additives.

The topmost hydrophobic protective layer can be applied directly on a support or on a support which has been subbed with various types of subbing layers, such as an adhesion promote layer, an antihalation layer, and a conductive subbing layer.

The hydrophobic protective layers useful in the practice of the invention can be applied by any of a number of well-know techniques, such as dip coating, rod coating, blade coating, air knife coating, gravure coating, reverse roll coating, extrusion coating, slide coating, curtain coating, and the like. Addenda and the binder are preferably mixed together in a liquid medium to form a coating composition. The liquid medium may be a medium such as water or other aqueous solution in which film formers are dispersed with or without the presence of surfactants, or it may be a solvent such as an organic solvent in which the resin binder is dissolved. After coating, the protective layer is generally dried by simple evaporation, which may be accelerated by known techniques such as convection heating. Known coating and drying methods are described in further detail in *Research Disclosure* No. 308, Published Dec. 1989, pages 1007 to 1008.

The invention is further illustrated by the following examples in which parts and percentages are by weight unless otherwise specified.

Examples 1 to 8 and Comparative Samples A to G

A series of photographic elements are prepared as follows: A cellulosetriacetate film support having an antihalation layer on one side and hydrophobic protective layers on the other side (as described below) is coated on the antihalation layer with the following image forming layers in sequence as set forth in Example 2 of U.S. Pat. No. 5,288,598: a slow cyan-dye forming layer, a fast cyan-dye forming layer, an interlayer, a slow magenta-dye forming layer, a fast megenta-dye forming layer, an interlayer, a slow yellow-dye forming layer, a fast yellow-dye forming layer, and a UV layer.

Preparation of Hydrophilic Front Side Topmost Layer

A protective topmost layer containing gelatin binder and matting agents of the invention was coated on the top of the UV layer and has the following composition listed in Table 1.

TABLE 1

Composition of the Protective layer (Layer A)

| | |
|---|---|
| a. Gelatin, lime processed | 888 mg/m$^2$ |
| b. Silicone lube, DC-200 (Dow Corning) | 40.1 mg/m$^2$ |
| c. Fluorad FC-134 (3M Co.) | 3.9 mg/m$^2$ |
| d. Aerosol OT (American Cyanamide) | 21.5 mg/m$^2$ |
| e. Surfactant Olin 10G (Olin Corp.) | 27.2 mg/m$^2$ |
| f. Matte (Table 2) | 5 to 150 mg/m$^2$ |

TABLE 2

Matte Particles

| ID | Composition | Particle Size | Rockwell Hardness |
|---|---|---|---|
| P-1 | Poly(methyl methacrylate) | 2.5 μm | >M90 |
| P-2 | Poly(methyl methacrylate-co methacrylic acid) 45/55 | 3.0 μm | >M90 |
| P-3 | Poly(vinyl toluene-cometh-acrylic acid) 60/40 | 1.5 μm | <M90 |
| P-4 | Poly(vinyl toluene) | 1.8 μm | <M90 |
| P-5 | Poly(vinyl toluene-codivinyl benzene) 80/20 | 1.5 μm | <M90 |

Preparation of the Hydrophobic Back Side Topmost Layer

On the support side opposite to that image forming layers was coated one of the following hydrophobic layers (Table 3). The Taber abrasion tests were carried out on these coatings according to ASTM D1044.

TABLE 3

Hydrophobic Protective Overcoat (Layer B)

| ID | Composition | Coverage | Delta Haze % mg/m$^2$ |
|---|---|---|---|
| H-1 | Witcobound 232 polyurethane (Witco Co.) | 1060 | 11 |
| H-2 | Cellulose Diacetate | 2755 | 8 |
| H-3 | Cellulose acetate/cellulose nitrate/Teflon 120*/Byk 331** | 270 | 23 |
| H-4 | Elvacite 2041***/Syloid 244**** | 1060 | 7 |
| H-5 | Elvacite 2041/poly(methyl methacrylate-co-ethylene | 1060 | 7 |

TABLE 3-continued

| Hydrophobic Protective Overcoat (Layer B) | | | |
|---|---|---|---|
| ID | Composition | Coverage | Delta Haze % mg/m$^2$ |
| | glycol dimethacrylate) | | |
| H-6 | Poly(methyl methacrylate-co methacrylic acid)/ICI Neorez R960 polyurethane/ PFAZ 232***** | 1060 | 7 |
| H-7 | Cellulose acetate/poly(vinyl benzyl chloride-co-ethylene glycol diacrylate)/triethylamine/ carnuaba wax | 93.5 | 35 |
| H-8 | Cellulose diacetate/cellulose triacetate/Co(γ)$Fe_2O_3$/$Al_2O_3$(α) | 1564 | 8 |

*Teflon 120: a fluorinated polymer particle dispersion sold by E.I. DuPont de Nemours and Co.
**Byk 331: a polyether modified dimethyl polysiloxane copolymer sold by BYK-Chemie
***Elvacite 2041: a methyl methacrylate polymer sold by E.I. DuPont de Nemours and Co.
****Syloid 244: a silica matting agent sold by W.R. Grace & Co.
*****PFAZ 232: a polyfunctional aziridine sold by Sybron Chemical Inc.

Matte Cinch Abrasion Test

Five strips each (30.5 cm×35 mm) of film having the front side matte containing topmost protective overcoat and film having the backside hydrophobic topmost protective layer are conditioned to 70° F./50%RH for 17 hours. The sample containing the back side protective layer is fastened, with the protective layer side up, in a fixture that contains a right angle edge which defines a verticle and horizontal surface. The samples containing the front side, protective layer are placed over the samples containing the back side protective layer so the front matte side is in contact with the back side of the affixed sample. A weight is affixed to the verticle surface of the front side sample. The front side samples are drawn in a horizontal direction away from the right angle. The samples are drawn at a weight of 10, 20, 50, 100, and 200 grams. The five samples containing the back side protective layer are qualitatively evaluated for resulting scratches under specular light (average): 0 =no scratches, 1=very few scratches, 2=few scratches, 3=some scratches, and 4=many scratches. The description of examples and the testing results are reported in Table IV.

TABLE IV

| Cinch Abrasion Data | | | | | |
|---|---|---|---|---|---|
| | Hydrophilic Overcoat | | Hydrophobic Overcoat | | Cinch |
| Example | Matte | Hardness | Coating | Delta Haze % | Abrasion Rating |
| Sample A | P1/P2 | >M90 | H-7 | 35 | 3 |
| Sample B | P4 | <M90 | H-7 | 35 | 2 |
| Sample C | P5 | <M90 | H-7 | 35 | 3 |
| Sample D | P1/P2 | >M90 | H-8 | 8 | 2 |
| Example 1 | P4 | <M90 | H-8 | 8 | 1 |
| Example 2 | P5 | <M90 | H-8 | 8 | 1 |
| Sample E | P-1/P-2 | >M90 | H-1 | 11 | 2 |
| Sample F | P-1/P-2 | >M90 | H-3 | 23 | 3 |
| Sample G | P-1/P-2 | >M90 | H-4 | 7 | 2 |
| Example 3 | P-5 | <M90 | H-1 | 11 | 1 |
| Example 4 | P-5 | <M90 | H-2 | 8 | 0 |
| Example 5 | P-5 | <M90 | H-3 | 23 | 1 |
| Example 6 | P-5 | <M90 | H-4 | 7 | 1 |
| Example 7 | P-5 | <M90 | H-5 | 7 | 0 |
| Example 8 | P-5 | <M90 | H-6 | 7 | 0 |

As indicated in Table IV use of matte particles of Rockwell hardness of less than M90 in the front side hydrophilic protective layer in combination with the back side hydrophobic protective layer having a Taber delta haze value of less than 30 results in excellent cinch abrasion and scratch resistance.

The photographic elements of this invention exhibit many advantages in comparison with similar elements known heretofore. For example, since they are so resistant to cinch scratches, they can be used in very high speed manufacturing and finishing processes and they can be used in applications where film winding and unwinding, and stacking are repeated at high frequencies.

The photographic element of this invention can be used in processes where the element needs to be returned post-process in the cartridge for storage and future interface needs. In these processes, it is necessary to use a higher level of processing surviving mattes for reducing film self-adhesion since its back and front faces come into direct contact during post-process winding, unwinding, and handling operations. The photographic element of this invention allows a higher level of processing surviving mattes to be used without increasing the risk of the element to have more matte cinch scratches and abrasion marks.

The photographic processing steps to which the raw film may be subject may include, but are not limited to the following:

1.) color developing → bleach-fixing → washing/stabilizing;
2.) color developing → bleaching → fixing → washing/stabilizing;
3.) color developing → bleaching → bleach-fixing → washing/stabilizing;
4.) color developing → stopping → washing → bleaching → washing → fixing → washing/stabilizing;
5.) color developing → bleach-fixing → fixing → washing/stabilizing;
6.) color developing → bleaching → bleach-fixing → fixing → washing/stabilizing;

Among the processing steps indicated above, the steps 1), 2), 3), and 4) are preferably applied. Additionally, each of the steps indicated can be used with multistage applications as described in Hahm, U.S. Pat. No. 4,719,173, with co-current, counter-current, and contraco arrangements for replenishment and operation of the multistage processor.

Any photographic processor known to the art can be used to process the photosensitive materials described herein. For instance, large volume processors, and so-called minilab and microlab processors may be used. Particularly advantageous would be the use of Low Volume Thin Tank processors as described in the following references: WO 92/10790; WO 92/17819; WO 93/04404; WO 92/17370; WO 91/19226; WO 91/12567; WO 92/07302; WO 93/00612; WO 92/07301; WO 02/09932; U.S. Pat. No. 5,294,956; EP 559,027; U.S. Pat. No. 5,179,404; EP 559,025; U.S. Pat. No. 5,270,762; EP 559,026; U.S. Pat. No. 5,313,243; U.S. Pat. No. 5,339,131.

What is claimed is:

1. A photographic element comprising a support having a front side and a back side, an image forming layer on the front side of the support, a protective overcoat on the front side of the support further removed from the support than the image forming layer, the protective overcoat comprising process surviving matte particles in a hydrophilic binder, the matte particles having a Rockwell hardness of less than M90, the back side of the support having a protective overcoat layer, the protective overcoat layer being the layer furthest removed from the back side of the support and comprising a hydrophobic material having a Delta haze less than 30%.

2. The photographic element of claim 1 wherein the protective overcoat on the front side of the support is the topmost layer.

3. The photographic element of claim 1 wherein the matte particles are composed of at least 40 mol percent styrenic monomers.

4. The photographic element of claim 1 wherein the protective overcoat on the front side of the support contains non-process surviving matte particles.

5. The photographic element of claim 1 wherein the hydrophobic material is a polymer.

6. The photographic element of claim 5 wherein the polymer is a polyurethane, polyester, polycarbonate, cellulose esters or acrylic polymers.

7. The photographic element of claim 6 wherein the polymer is a polyurethane.

8. The photographic element of claim 6 wherein the polymer is a cellulosic ester.

9. The photographic element of claim 6 wherein the polymer is an acrylic polymer.

10. The photographic element of claim 6 wherein the polymer is a mixture of an acrylic polymer and a polyurethane.

11. The photographic element of claim 1 wherein the protective layer on the backside of the support contains a conductive polymer.

12. The photographic element of claim 1 wherein the protective layer on the backside of the support contains a conductive metal oxide.

13. The photographic element of claim 1 wherein the protective layer on the backside of the support contains magnetic particles.

14. The photographic element of claim 1 wherein the protective layer on the backside of the support contains a polymer having a hydrophilic group.

15. The photographic element of claim 1 wherein the protective layer on the backside of the support is crosslinked.

16. The photographic element of claim 1 wherein the matte particles are crosslinked.

17. The photographic element of claim 1 wherein the matte particles have a hydrophilic group.

18. The photographic element of claim 1 wherein the hydrophilic binder is present in a coverage of from 0.3 to 2 $g/m^2$.

19. The photographic element of claim 1 wherein the matte particles are present in a coverage of from 0.01 to 0.25 $g/m^2$.

* * * * *